United States Patent [19]

Mizutani et al.

[11] 4,230,039

[45] Oct. 28, 1980

[54] DRUM PRINTER WITH HELICALLY ARRANGED TYPE SETS

[75] Inventors: Nagao Mizutani, Hachioji; Toshio Kurihara, Tokorozawa; Yutaka Nishiyama, Higashiyamato; Masao Kunita, Sayama; Teruo Kinoshita; Makoto Yasunaga, both of Kawagoe, all of Japan

[73] Assignee: Citizen Watch Company Limited, Tokyo, Japan

[21] Appl. No.: 905,614

[22] Filed: May 12, 1978

[30] Foreign Application Priority Data

| | | | |
|---|---|---|---|
| May 20, 1977 | [JP] | Japan | 52-57651 |
| May 24, 1977 | [JP] | Japan | 52-60204 |
| May 24, 1977 | [JP] | Japan | 52-60205 |
| May 24, 1977 | [JP] | Japan | 52-50206 |

[51] Int. Cl.[3] ..... B41J 1/24

[52] U.S. Cl. ..... 101/93.17; 101/93.23; 101/110; 101/93.09

[58] Field of Search ..... 101/93.09, 93.15, 93.17, 101/93.23, 93.37, 93.38, 93.39, 93.40, 110; 400/152, 157

[56] References Cited

U.S. PATENT DOCUMENTS

| | | | |
|---|---|---|---|
| 2,926,602 | 3/1960 | MacDonald et al. | 101/93.17 |
| 3,433,153 | 3/1969 | Harrington et al. | 101/93.09 |
| 3,599,772 | 8/1971 | Comstock | 101/93.23 X |
| 3,604,347 | 9/1971 | Muterspaw | 101/93.09 |
| 3,669,237 | 6/1972 | Wagner et al. | 101/93.23 X |
| 3,675,753 | 7/1972 | Perucca | 101/93.17 X |
| 3,724,631 | 4/1973 | Kaczeus | 101/93.17 X |
| 3,896,919 | 7/1975 | Hutley | 101/93.23 X |

*Primary Examiner*—Edward M. Coven

*Attorney, Agent, or Firm*—Jordan and Hamburg

[57] ABSTRACT

A printing apparatus includes a type drum the outer circumferential surface of which has a first set of type including a plurality of type faces arranged in a counterclockwise spiral and a second set of type including a plurality of type faces arranged in a clockwise spiral. The type drum is both reciprocated and rotated in synchronous fashion by cooperation between reciprocating and rotating drive means so that the sets of type disposed on the type drum pass the positions of a plurality of printing hammers confronting the drum and adapted to perform printing by striking the type faces on the drum through an inked ribbon and recording medium.

32 Claims, 19 Drawing Figures

Fig. 6

| Row \ Column | A | B | C | D |
|---|---|---|---|---|
| 0 | | 0 | @ | P |
| 1 | ! | 1 | A | Q |
| 2 | " | 2 | B | R |
| 3 | # | 3 | C | S |
| 4 | S | 4 | D | T |
| 5 | % | 5 | E | U |
| 6 | & | 6 | F | V |
| 7 | ' | 7 | G | W |
| 8 | ( | 8 | H | X |
| 9 | ) | 9 | I | Y |
| 10 | * | : | J | Z |
| 11 | + | ; | K | [ |
| 12 | , | < | L | ¥ |
| 13 | — | = | M | ] |
| 14 | . | > | N | ^ |
| 15 | / | ? | O | _ |

Fig. 7

| Row \ Column | A | B | C | D |
|---|---|---|---|---|
| 0 | | ー | タ | ミ |
| 1 | 。 | ア | チ | ム |
| 2 | 「 | イ | ツ | メ |
| 3 | 」 | ウ | テ | モ |
| 4 | | エ | ト | ヤ |
| 5 | ・ | オ | ナ | ユ |
| 6 | ヲ | カ | ニ | ヨ |
| 7 | ァ | キ | ヌ | ラ |
| 8 | ィ | ク | ネ | リ |
| 9 | ゥ | ケ | ノ | ル |
| 10 | ェ | コ | ハ | レ |
| 11 | ォ | サ | ヒ | ロ |
| 12 | ャ | シ | フ | ワ |
| 13 | ュ | ス | ヘ | ン |
| 14 | ョ | セ | ホ | ゛ |
| 15 | ッ | ソ | マ | ゜ |

DRUM PRINTER WITH HELICALLY ARRANGED TYPE SETS

This invention relates to a printing mechanism for use in a line printer, and more particularly to an improvement in a type drum for a line printer in which the type drum having a plurality of type faces disposed on its outer circumferential surface rotates at a constant speed so that, when a desired type face arrives at a prescribed position in a given column, a corresponding hammer is actuated to register the desired type face on a recording medium.

Line printers of the kind described are used extensively in the input-output devices of computers. In order to increase the printing capacity, namely the variety of type characters, numbers and symbols which can be printed, it has been necessary to increase the outer circumferential area of the drum by enlarging its diameter. In ordinary circumstances, that enlarges the overall size of the printer which therefore comes to occupy a larger amount of space in a terminal or information processor. Another short-coming was the fact that the increased moment of inertia of the larger drum degraded the starting characteristics of the printer, increased power consumption and raised costs.

One prior art method of reducing the diameter of the type drum while increasing printing capacity has been the adoption of a system which shifts the drum. However, when printing characters of the same variety, it was necessary to rotate the prior art drum N-times for a drum diameter on the order of 1/N; accordingly, the drum had to be shifted by (N−1) stages. The disadvantages encountered here were excessive noise during shifting, a reduction in durability, and a drop in printing speed since printing could not be performed during the shifting operation. In the conventional line printers there was also the problem of poor printing quality due to a side printing phenomenon in which type faces adjacent to those to be printed were caused to be printed on the recording medium. This the side printing phenomenon occurred due to the rigidity of the paper when using thick paper of 90 kg weight or many sheets of carbon paper.

It is therefore an object of the present invention to overcome the abovementioned shortcomings encountered in the prior art through the provision of a type drum of a reduced diameter which does not necessitate a reduction in printing capacity or a reduction in the size of type, and which is moreover adapted to operate without excessive noise and without a decrease in durability owing to shifting of the drum.

Another object of the present invention is the provision of a type drum having a plurality of type face sets, wherein the selection of a required type face set from a single drum makes it possible to eliminate dead time and thus shorten time required for the printing operation.

Still another object of the present invention is the provision of a type drum which can be adapted to the properties of the printing medium to prevent a side printing phenomenon, and which satisfies the abovementioned line printer requirements to as great an extent as possible.

To this end, the present invention is characterized by providing the outer circumferential surface of a type drum with a first set of type including a plurality of type faces arranged in a counter-clockwise spiral, and a second set of type including a plurality of type faces arranged in a clockwise spiral.

Other objects and advantages of the present invention will be apparent upon reading the following detailed description of illustrative embodiments in conjunction with the drawings, in which:

FIG. 6 is a table which shows all the varieties of type accommodated on the type drum of the first embodiment and half the varieties of type accommodated on the type drum of the second embodiment;

FIG. 7 is a table which shows the remaining half of the varieties of type accommodated on the type drum of the second embodiment;

Figure 11A:
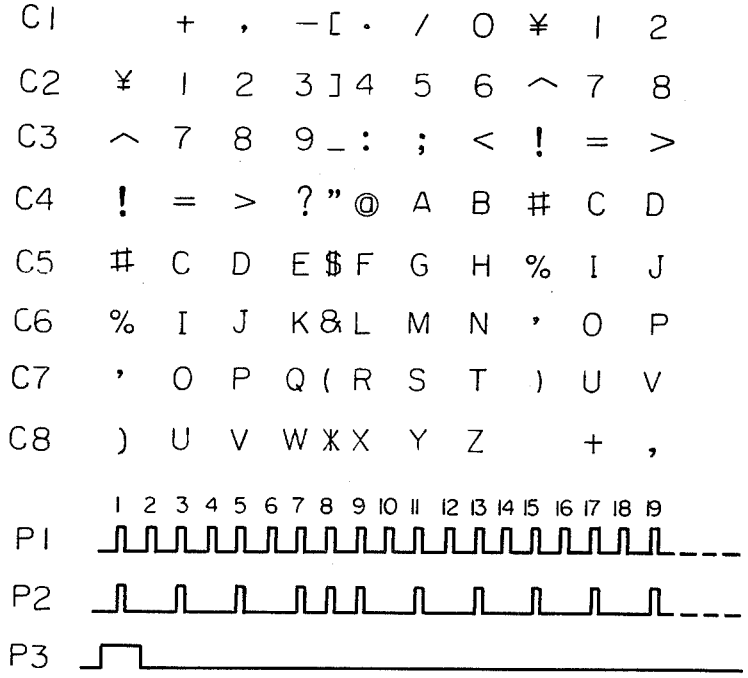
Figure 11B:
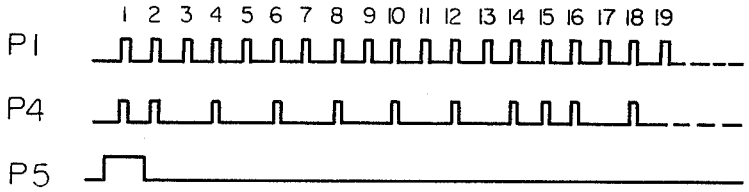
Figure 12:
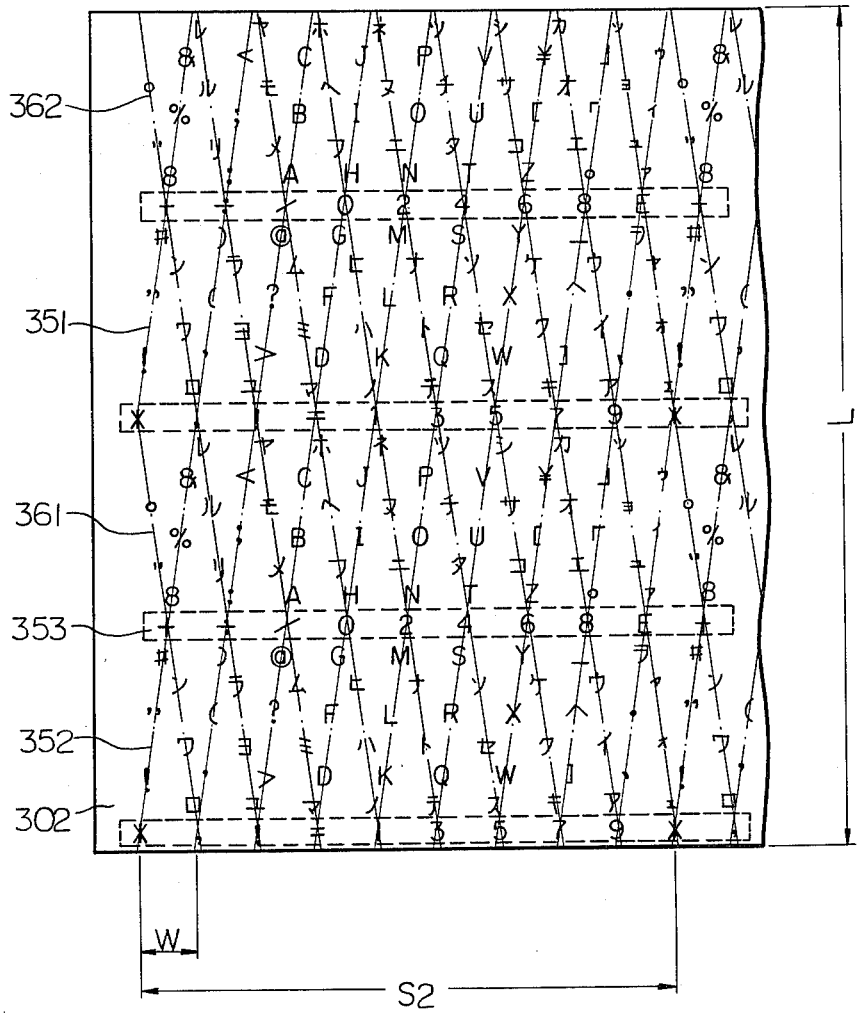
Figure 14:
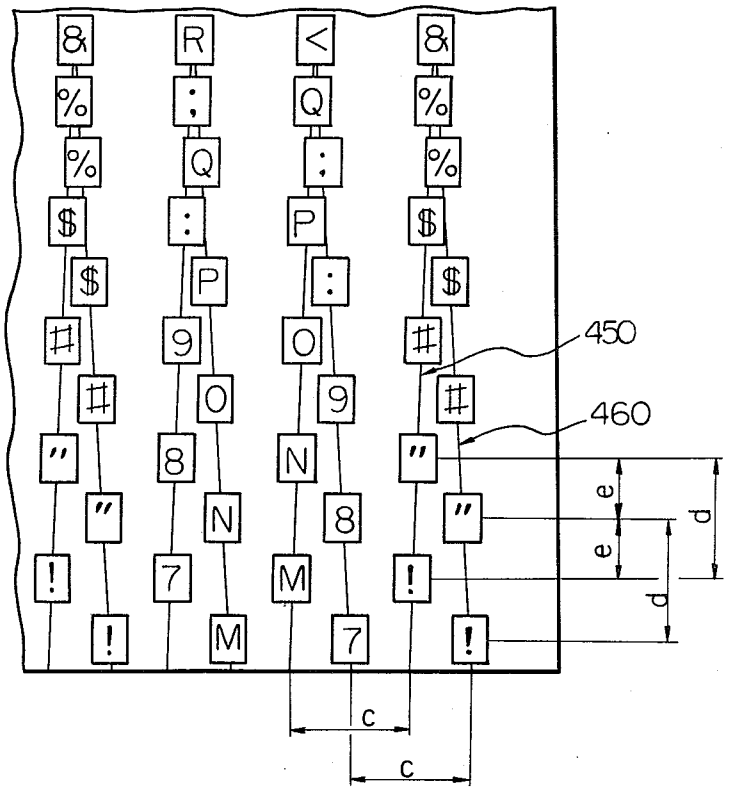
Figure 13:
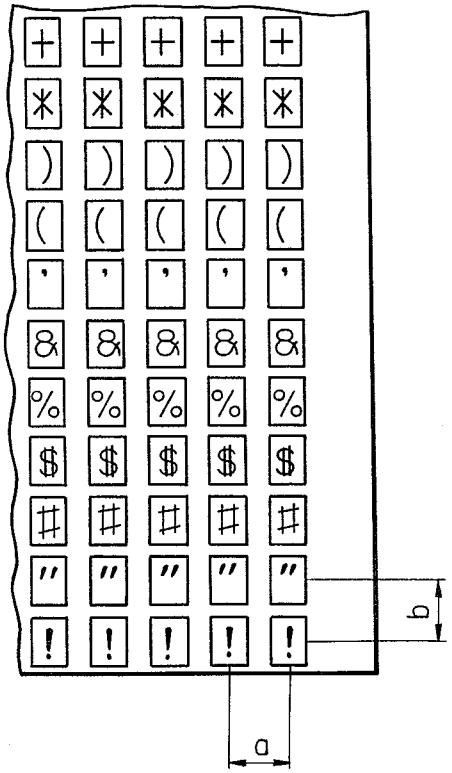
Fig. 13 PRIOR ART
Figure 15:
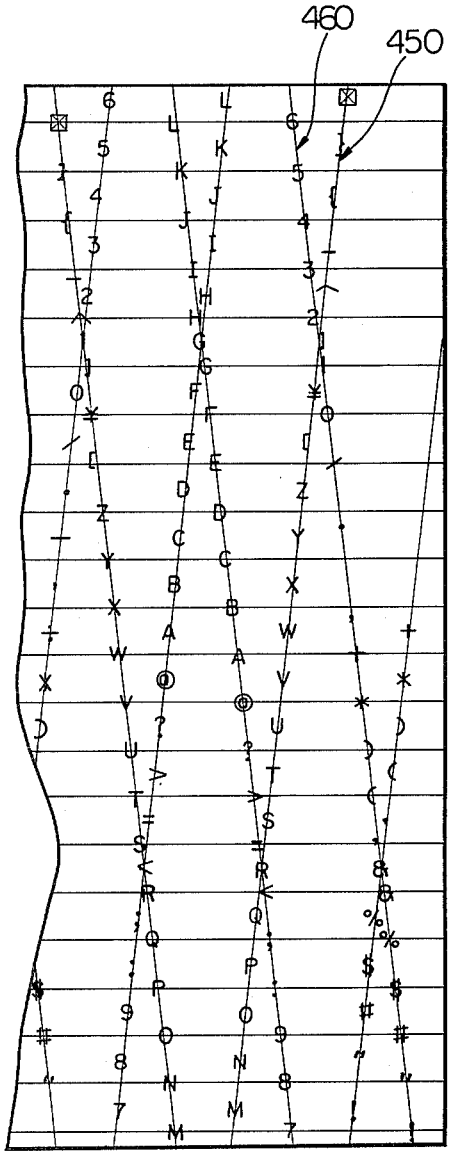
Figure 16:
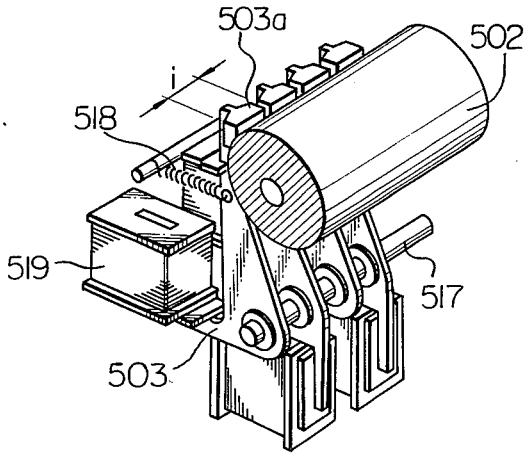
Figure 17:
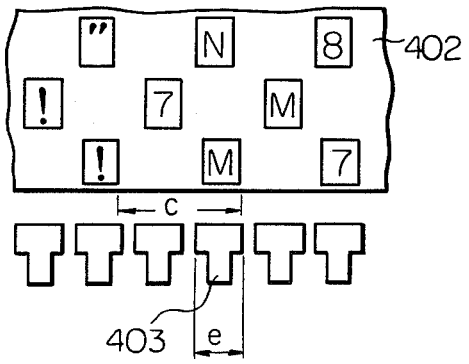
Figure 18:
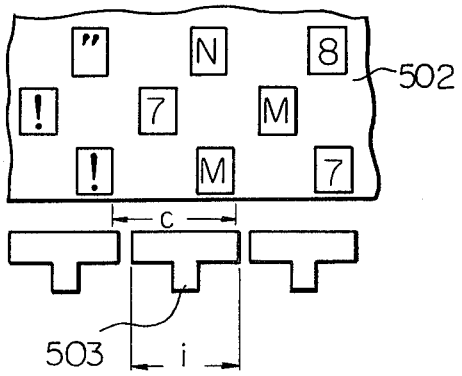

FIGS. 11A and 11B are diagrams useful for describing the relationships among type face arrays for each column as they are disposed on a type drum, the type face positions being shown in correspondance with type position detection pulses, type starting position pulses for traversals to the left and right, type position pulses for traversals to the left and right, and type position pulses for traversals to the left;

FIG. 12 is an expanded view of a portion of a fourth embodiment of a portion of a type drum;

FIG. 13 is an expanded view of a portion of a type drum in accordance with the prior art;

FIGS. 14 and 15 are expanded views of a portion of a fifth embodiment of a portion of a type drum;

FIG. 16 is a perspective view of a sixth embodiment of hammer means;

FIG. 17 is a diagram useful for describing the positioning of hammers with respect to the type drum of the fifth embodiment; and FIG. 18 is a diagram useful for describing the positioning of hammers with respect to the type drum of the sixth embodiment.

Figure 1:
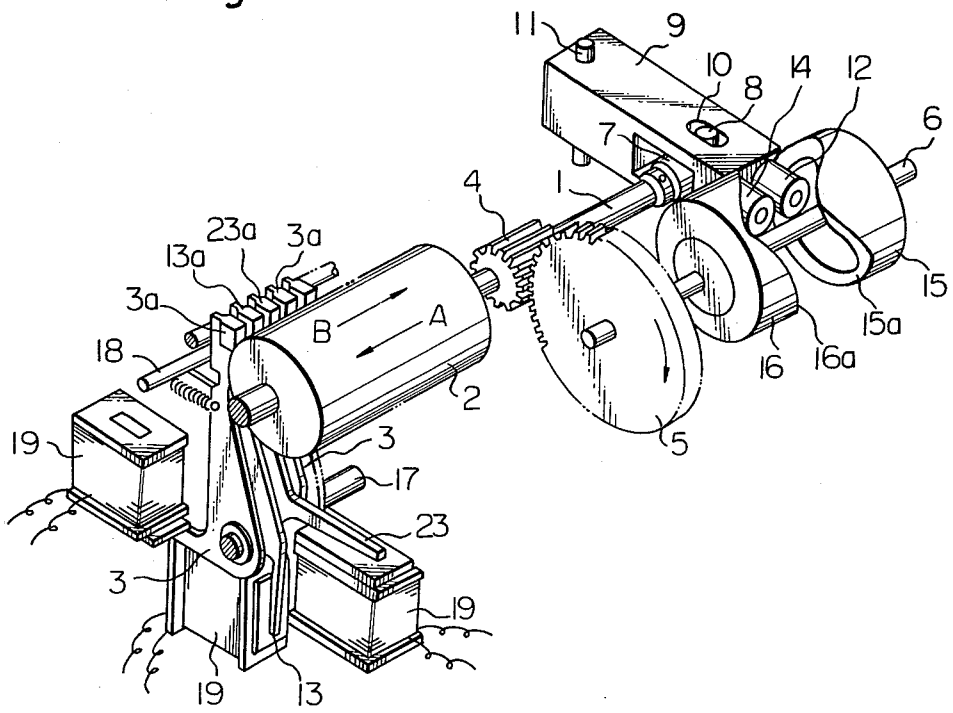
FIG. 1 is a perspective view of a line printer employing a first preferred embodiment of a type drum in accordance with the present invention.

Referring to FIG. 1, type drum 2 secured to a drum shaft 1 is capable of rotational and axial motion. The outer circumferential surface of type drum 2 is provided with a first plurality of type faces arrayed in a clockwise spiral of a single track, and a second plurality of type faces arrayed in a counter-clockwise spiral of a single track which intersects the first plurality of type faces and has the same lead angle as the clockwise spiral.

Figure 2:
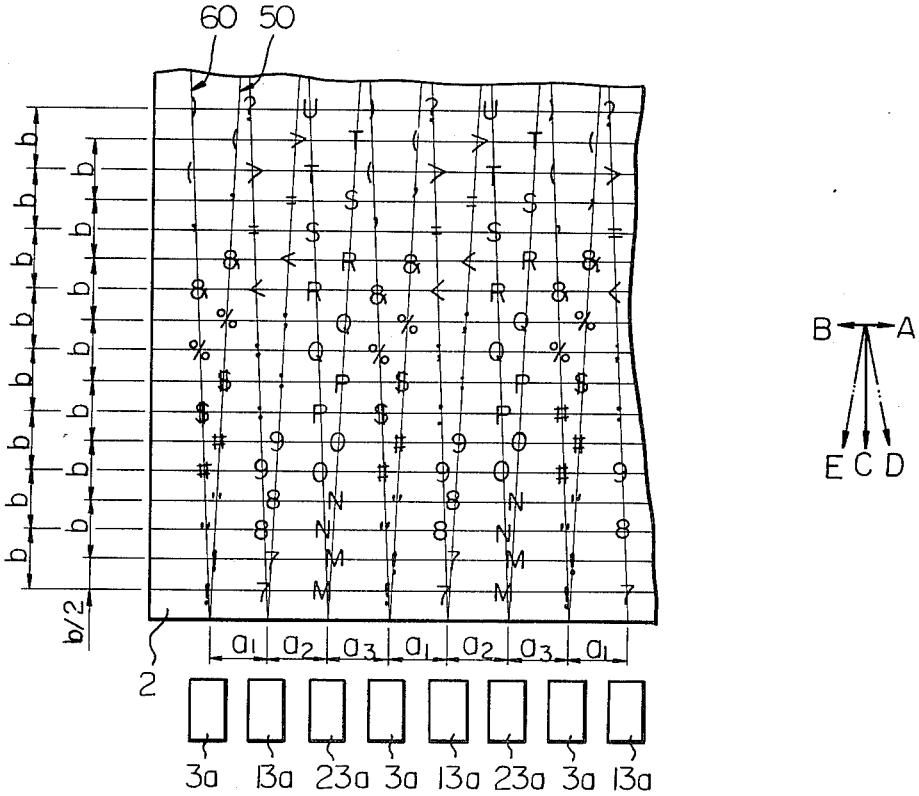
FIG. 2 is an expanded view of a portion of the type drum shown in FIG. 1.

The type face arrangement can best be seen in FIG. 2 which shows an array of 64 kinds of type faces according to the present embodiment. More specifically, FIG. 2 illustrates an expanded view of a portion of type drum 2 which is capable of printing the kinds of type shown in columns A through D of FIG. 6.

Referring to FIG. 2 in more detail, type drum 2 is driven by a type drum driving device to be described later. When the drum is moved in the axial direction rightward as viewed in FIG. 2 in synchronism with the rotational movement, each type face is caused to traverse axially in the direction of arrow A and rotationally in the direction of arrow C, thereby travelling in the direction of arrow D as indicated by the phantom line. Likewise, when the drum is moved leftward as viewed in FIG. 2, each type face is caused to traverse axially in the direction of arrow B and rotationally in the direction of arrow C, thereby travelling in the direction of arrow C which is also indicated by a phantom line. A first set of type faces 50 arrayed on the outer circumference of type drum 2 in a counter-clockwise spiral has a uniform pitch spacing b in the circumferential direction. Numerals 3*a*, 13*a*, and 23*a* denote hammers which impact type drum 2 through the intermediary of a recording medium (i.e. paper) and a printing ribbon, which are omitted from FIG. 1 and FIG. 2 for clarity of description. Each of the hammers serves to print in a corresponding column on the recording medium. Each of the first set of type faces 50 and a second set of type faces 60, is arranged on the outer cylindrical surface of type drum 2 along a helical path, as shown partially in FIG. 2. Each set of type faces comprises a plurality of characters, consisting of a character set which is cyclically repeated along the helical path of the set of type faces. The character set is shown in FIG. 6. In the embodiment shown in FIG. 2, the same character set is used in both the first and second set of type faces 50 and 60, and consists of the letters of the English alphabet, the numerals 0 to 9, and symbols such as #, $ etc. In this embodiment, the length of the character set occupies three complete pitches of the helical path of a set of type faces. Characters in the character set of the leftmost three pitches of type faces set 50 or 60 are printed by the first set of three hammers 3*a*, 13*a*, and 23*a*, the characters in the character set of the next three pitches of type face set 50 or 60 to the right are printed by means of the next group of three hammers 3*a*, 13*a* and 23*a* to the right, and so on. When type drum 2 makes 1 revolution and travels in the axial direction from right to left by a first pitch $a_1$, 22 varieties of type from the first set of type faces 50 illustrated in FIG. 6, namely type faces "space", !, ", #, . . . 4, 5, are successively advanced past each of the hammers denoted by the numerals 3*a*. When the drum is rotated through another single revolution and advanced axially from right to left by a second pitch $a_2$, 22 varieties of type from the first set, namely 6, 7, 8, . . . J, K are successively advanced past each of the hammers denoted by the numerals 3*a*. If the drum is rotated through still another single revolution and advanced axially from right to left by a third pitch $a_3$, 20 varieties of type from the first set, namely L, M, N, . . . ^,—are successively advanced past each of the hammers denoted by the numerals 3*a*.

Thus, during a traverse of type drum 2 from right to left in which type drum 2 rotates through three complete revolutions, all of the characters in the character set become successively aligned opposite each of the hammers denoted as 3*a*. Similarly, all of the characters in the character set become successively aligned opposite each of the hammers denoted as 13*a* during such a traverse from right to left, although at different timings from those for hammers 3*a*, and all of the characters in the characters set become successively aligned opposite each of the hammers 23*a* during such a traverse. At one point during such a traverse, for example, the characters " 8 and N will be aligned opposite each of the hammers 3*a*, 13*a* and 23*a* respectively. After type drum 2 has rotated through a circumferential distance of b, then the characters #9 and 0 will be aligned opposite the hammers 3*a*, 13*a* and 23*a* respectively.

On the other hand, a second set of type faces 60 arrayed on the outer circumference of type drum 2 in a clockwise spiral has a uniform pitch spacing b in the circumferential direction, but the type faces on this spiral are staggered in the circumferential direction by ½ pitch, i.e., b/2, with respect to the type faces of the first set 50.

When type drum 2 makes 1 revolution and advances in an axial direction from left to right by a first pitch $a_3$, 22 varieties of type from the second set of type faces 60, which are illustrated in FIG. 6, namely type faces "space" !, ", #, . . . 4, 5 become successively aligned opposite each of the hammers 3*a*. When the drum is rotated through another single revolution and advanced axially by a second pitch $a_2$, 22 varieties of type from the second set, namely 6, 7, 8, . . . J, K are advanced. If the drum is rotated through still another single revolution and advanced axially by a third pitch $a_1$, 20 varieties of type from the second set, namely L, M, N . . . ^,—become successively aligned opposite each of the hammers 3*a*. Thus, all of the 64 varieties of type in a character set of the set of type faces 60 pass successively before each of the hammers 3*a*, during a traverse of type drum 2 from left to right in which type drum 2 rotates through three complete revolutions. Similarly, all of the characters in the character set become successively aligned opposite each of the hammers denoted as 13*a* during such a traverse from left to right, although at different timings from those of hammers 3*a*, and all of the characters of the type set become successively aligned also opposite each of the hammers 23*a* during such a traverse. The printing pitch spacing in the axial direction is arranged such that $a_1=a_2=a_3$.

Thus, rotating type drum 2 through 3 revolutions in the manner described allows all 64 varieties of type to pass in front of the faces of hammer heads 3*a*, 13*a*, 23*a* so that a desired type can be selected from the 64 varieties.

In order to move the type drum 2 in the manner described, an embodiment of a type drum driving device in accordance with the present invention will now be described with reference once again to FIG. 1.

The type drum driving device is comprised of a driving gear mechanism which serves as rotating means for rotationally driving the type drum, and a cam device which serves as reciprocating drive means for reciprocating the type drum 2 in the axial direction. A pinion 4 fixed to drum shaft 1 meshes with a gear 5 having 7 times as many teeth, the cam shaft 6 of gear 5 being axially and rotatably supported by a frame (not shown) and connected to a motor mechanism (not shown). The cam shaft 6 is adapted to be driven by motor means the operation of which is controlled by a printing instruction. Owing to this rotation, drum shaft 1 is driven through gear 5 and pinion 4, and is axially supported by the frame for both rotational motion and simultaneous sliding motion in the axial direction. Although freely rotatable, drum shaft 1 is provided with a ring 7 for restricting its sliding motion in the axial direction, the ring providing fixed support for a pin 8 that engages with an oblong slot 10 formed in a rocking lever 9 supported so as to rock about a stationary shaft 11 secured to the frame. Cam followers 12, 14 provided at the extremity of rocking lever 9 make contact with a pair of bell cams 15, 16, which are positive motion cams secured to cam shaft 6, and move following the rotation of the shaft and the cam faces 15*a*, 16*a*. Type drum 2 is thus caused to move in the axial direction.

Although not shown in the drawing, type detection means is attached to drum shaft 1 in order to detect the travel timing of the type due to rotation of the type drum 2. A more detailed description will be had later with reference to a third embodiment.

Figure 3:
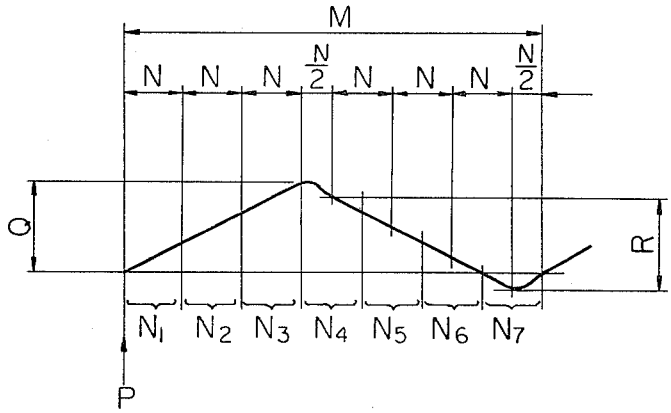
FIG. 3 is a cam diagram of positive motion cams shown in FIG. 1.

FIG. 3 is a cam diagram of the positive motion cams mentioned above. The angle of rotation of cam shaft 6 and type drum shaft 1 is shown on the axis of abscissa, and the amount of traversal of the type drum 2 is shown on the ordinate axis. M denotes one revolution of cam shaft 6, and N designates one revolution of type drum 2, where 7 N=M. P represents the point in time at which printing starts, N1 denotes the first revolution of type drum 2, N2 denotes the second revolution of the type drum, and N7 similarly designates the seventh revolution of the type drum. Q and R denote the amount of axial travel of type drum 2 and, in the present embodiment, correspond to a distance of six columns. As the diagram shows, the linear portion of the curve indicates that type drum 2 travels in the axial direction (in the direction of arrow A in FIG. 1) at a uniform speed during the first, second and third revolutions of the drum. When type drum 2 has completed one-half of the fourth revolution, the curve shows a reversal in the direction of axial drum travel. During the three revolutions from the latter half of the fourth revolution to the first half of the seventh revolution, the linear portion of the curve indicates that the drum travels in the axial direction (in the direction of arrow B in FIG. 1) at a uniform speed. In the latter half of the seventh revolution, the curve again shows a reversal in the direction of axial drum travel. The cams are therefore suitably curved in order to facilitate the changes in velocity and acceleration that accompany these reversals in direction. Although not shown, cam shaft 6 is provided with type start detection means for detecting the starting points of type drum 2 as it moves axially to the right and left. This will be described later in more detail with respect to a third embodiment.

Provided in the proximity of type drum 2 is a known hammer driving device adapted to register type faces, selected from the outer circumferential surface of the type drum, on a recording paper by means of an inked ribbon, neither the paper nor the ribbon being shown in the drawings. In the present embodiment, a printing solenoid is provided for each column. A hammer shaft 17 provides rotatable support for a number of hammers 3, 13, 23 having hammer heads 3*a*, 13*a*, 23*a* arranged to face the outer circumferential surface of type drum 2 in close proximity thereto. Each hammer 3, 13, 23 is biased away from the drum by means of a spring 18. Each hammer is provided with a corresponding printing solenoid 19 which, upon being supplied with an excitation current, attracts its corresponding hammer against the biasing force of spring 18 so that the hammer head strikes type drum 2 to perform a printing operation.

According to the first embodiment of the present invention as illustrated in FIGS. 1 to 3, a printing operation proceeds in the following manner. At the time that the printer is actuated, type drum 2 is positioned at the extreme right-hand side of FIG. 1 (in the direction of arrow A). The drum begins its rotational and axial movement from this position and traverses the front faces of hammer heads 3*a*, 13*a*, 23*a*, the type faces from each set advancing in the proper order. Although not shown in the drawing, means for detecting the start of drum travel in the right and left directions, and known type detection means for detecting travel timing of the type due to rotation of type drum 2, as well as a known control circuit make it possible to memorize and discriminate among the characters passing by in front of the hammer heads 3*a*, 13*a*, 23*a* corresponding to each column. When characters passing in this continuous fashion coincide with the desired printing signal of a desired column, an excitation current is supplied to the printing solenoid of each corresponding column, whereupon one line of printing is completed by registering the corresponding type faces on a recording paper. After type drum 2 has made its first traversal, the direction of its longitudinal travel changes so that the drum once again traverses the front faces of hammer heads 3*a*, 23*a*, 13*a* and performs the printing of a second line by registering the type in the manner described above. Thus, as type drum 2 traverses the hammer portions, 3*a*, 13*a*, 23*a*, two lines are printed for each single reciprocating action, each type face from the type sets on the drum passing the hammer heads in order.

Figure 4:
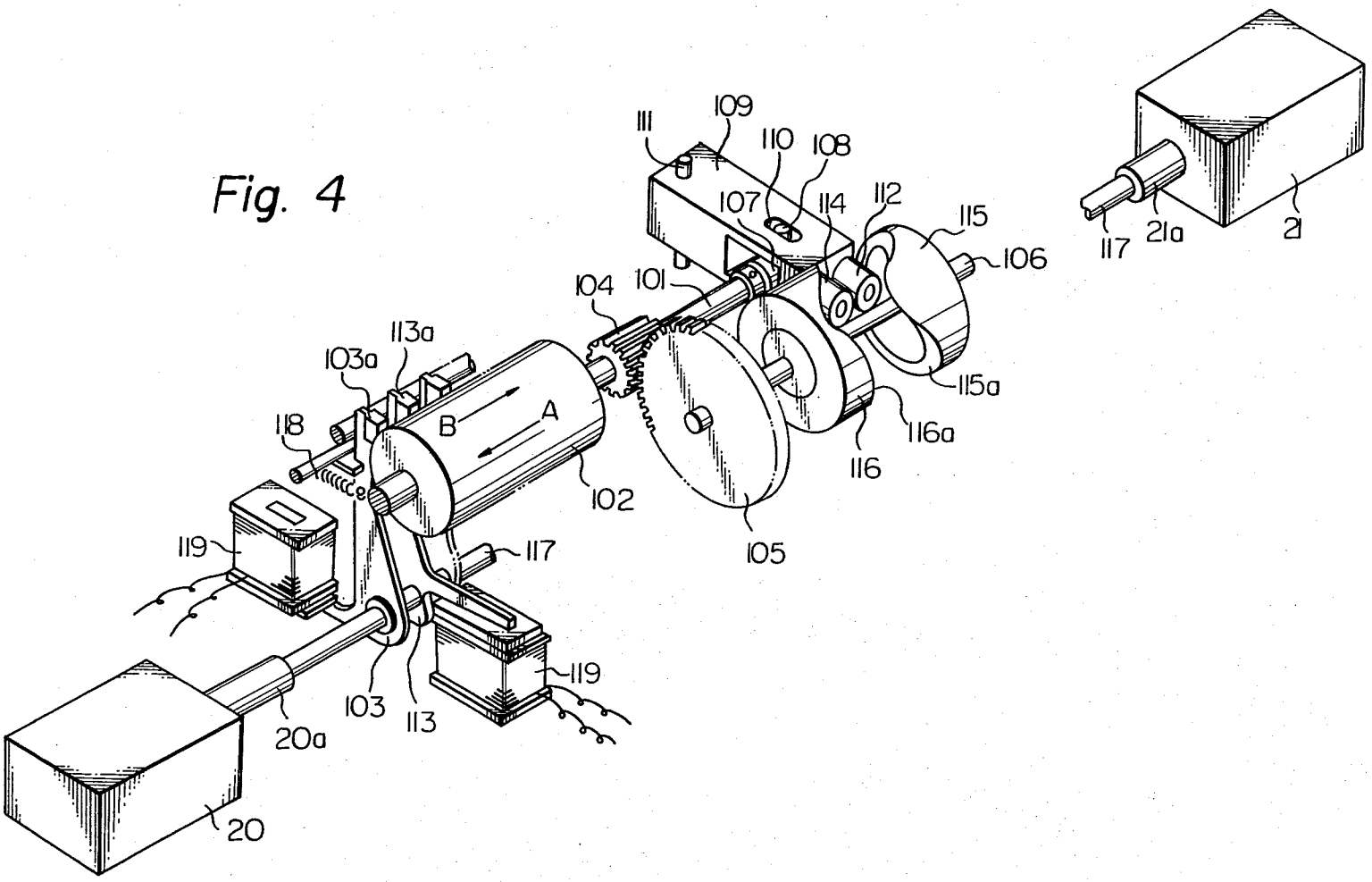
FIG. 4 is a perspective view of a line printer employing a second preferred embodiment of a type drum in accordance with the present invention.

FIG. 4 is a perspective view of a second preferred embodiment of a line printer which utilizes a type drum in accordance with the present invention. Parts which operate in the same fashion as those illustrated in FIG. 1 are denoted by the same reference numerals although the numerals are incremented by 100. The same will hold true for all other embodiments hereafter. Structures and operations which are entirely similar will not be described.

A type drum 102 secured to a drum shaft 101 is capable of rotational and axial motion. The outer circumferential surface of type drum 2 is provided with a first plurality of type faces arrayed in a counter-clockwise spiral of double tracks, and a second plurality of type faces arrayed in a clockwise spiral of double tracks which intersect the first plurality of type faces and have the same lead angle as the counter-clockwise spiral.

Figure 5:
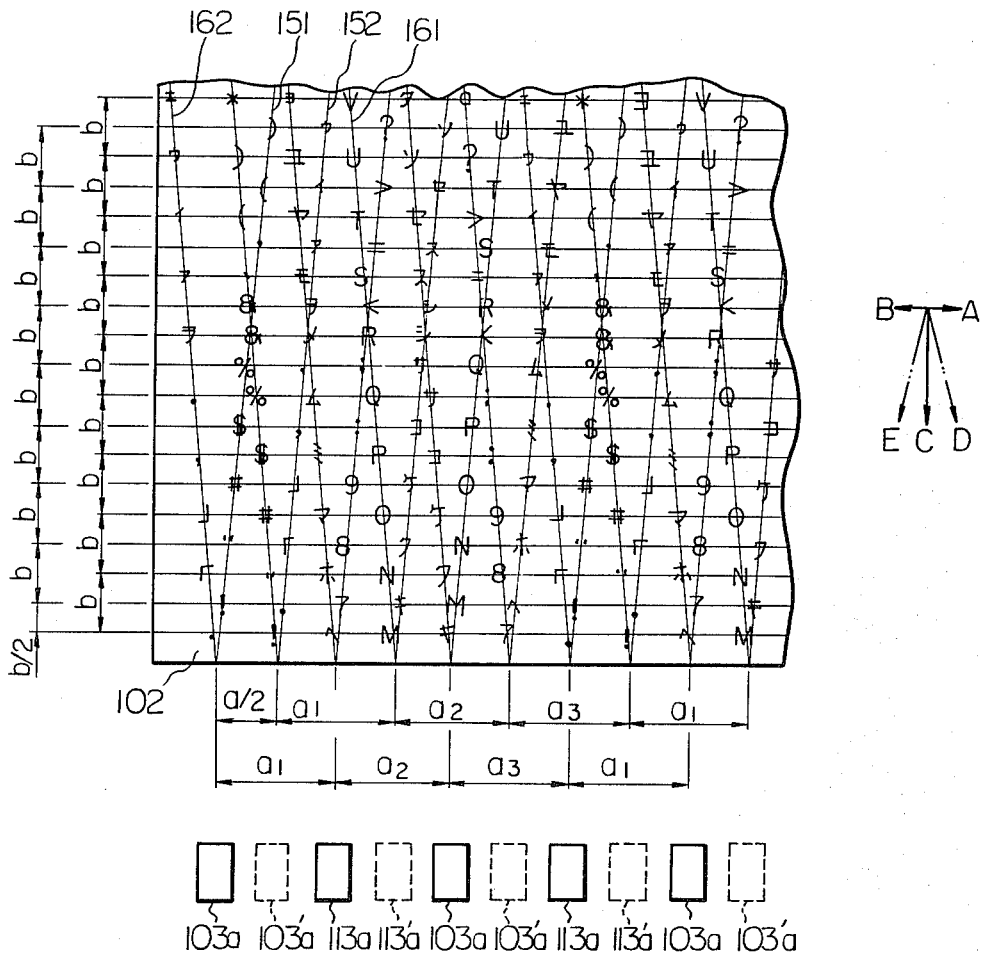
FIG. 5 is an expanded view of a portion of the type drum shown in FIG. 4.

The type arrangement can best be seen in FIG. 5 which shows an array of 128 characters according to the present embodiment. More specifically, FIG. 5 illustrates a portion of a developed view of type drum 102 which is capable of printing the kinds of type shown in columns A through D of FIG. 6 and A through D of FIG. 7.

Referring to FIG. 5 in more detail, type drum 102 is adapted so that the type can travel in the directions of arrows D and E as described above with reference to FIG. 1. The outer circumferential surface of type drum 102 is provided with a first series of type faces 51 and a second series of type faces 152 that comprise a first set of type arrayed in a counter-clockwise spiral of double tracks, the first series of type faces 151 having a uniform pitch spacing of b in the circumferential direction. When type drum 102 makes 1 revolution and advances in the axial direction by a first pitch $a_1$, 22 varieties of type from the first series of type faces 51 illustrated in FIG. 5, namely type faces "space", !, ", . . . 4, 5 are advanced. When the drum is rotated through another single revolution and advanced axially by a second pitch $a_2$, 22 varieties of type from the first series, namely 6, 7, 8, . . . J, K are advanced. If the drum is rotated through still another single revolution and advanced axially by a third pitch $a_3$, 20 varieties of type from the first series, namely L, M, N . . . ^,—are advanced. This first series of type faces 51 is disposed such that the 64 varieties of type pass repetitively by the required number of columns. The second series of type faces 152 is disposed on the type drum in circumferential positional agreement with the first series of type faces 151, but the type faces on this spiral are staggered in the longitudinal direction by ½ pitch, i.e., a/2, with respect to the type faces of the first series. This second series of type faces 52 is arrayed in a counter-clockwise spiral of two tracks having a uniform pitch spacing b in the circumferential direction. When type drum 2 makes 1 revolution and advances in the axial direction by a first pitch $a_1$, 22 varieties of type from the second series of type faces 152 illustrated in FIG. 7, namely type faces "space", ., ｢ . . . ｺ, ｷ are advanced. When the drum is rotated through another single revolution and advanced axially by a second pitch $a_2$, 22 varieties of type from the second series, namely ﾀ, ｷ, ｸ , . . . ﾊ, ﾋ are advanced. If the drum is rotated through still another single revolution and advanced axially by a third pitch $a_3$, 20 varieties of type from the second series, namely ﾌ, ﾍ, ﾎ , . . . ", . are advanced. This second series of type faces 152 is disposed such that the 64 varieties of type pass repetitively by the required number of columns.

On the other hand, the outer circumferential surface of type drum 102 is also provided with a third series of type faces 161 and a fourth series of type faces 162 that comprise a second set of type arrayed in a clockwise spiral of two tracks. The third series of type faces 162 has a uniform pitch spacing b in the circumferential direction, but the type faces on this spiral are staggered in the circumferential direction by ½ pitch, i.e., b/2, with respect to the type of the first set having the abovementioned counter-clockwise spiral configuration of double tracks. When type drum 102 makes one revolution and advances in the axial direction by a first pitch $a_3$, 22 varieties of type from the third series of type faces 161 illustrated in FIG. 7, namely type faces "space", . , ｢, . . . ｺ, ｷ are advanced. When the drum is rotated through another single revolution and advanced axially by a second pitch $a_2$, 22 varieties of type from the third series, namely ﾀ, ｷ, ｸ , . . . ﾊ, ﾋ are advanced. If the drum is rotated through still another single revolution and advanced axially by a third pitch $a_1$, 20 varieties of type from the third series, namely ﾌ, ﾍ, ﾎ , . . . ", . are advanced. This third series of type faces 161 is disposed such that the 64 varieties of type pass repetitively by the required number of columns. The fourth series of type faces 162 is disposed on the drum in circumferential positional agreement with the third series of type faces 161, but the types on this spiral are staggered in the axial direction by ½ pitch, i.e., a/2, with respect the type faces of the third series. This fourth series of type 162 is arrayed in a clockwise spiral of double tracks having a uniform pitch spacing b in the circumferential direction. When type drum 102 makes 1 revolution and advances in the axial direction by a first pitch $a_3$, 22 varieties of type from the fourth series of type 162 illustrated in FIG. 6, namely type faces "space", !, ", . . . 4, 5 are advanced. When the drum is rotated through another single revolution and advanced axially by a second pitch $a_2$, 22 varieties of type from the fourth series, namely type faces 6, 7, 8 . . . J, K are advanced. If the drum is rotated through still another single revolution and advanced axially by a third pitch $a_1$, 20 varieties of type from the fourth series, namely L, M, N . . . ^,—are advanced. This fourth series of type faces 162 is disposed such that 64 varieties of type pass repetitively by the required number of columns. The printing pitch spacing in the axial direction is a/2, where $a_1 = a_2 = a_3$.

Using the type arrangement described above and a hammer shift device to be described later, the following table shows the printing operations performed by hammer and shift combinations.

| Type variety | Direction of axial movement | Shift position | |
|---|---|---|---|
| Alpha-numeric type | A | 103'a | 113'a |
| | B | 103a | 113a |
| Kana type | A | 103a | 113a |
| | B | 103'a | 113'a |

As the chart shows, hammer heads 103*a*, 113*a* at odd-numbered columns attain positions 103'*a*, 113'*a* after being shifted to even-numbered columns. The directions of axially-directed type drum movement are the directions of arrows A and B in FIG. 3. The alpha-numeric type is the 64 varieties of type shown in FIG. 6, and the kana type is the 64 varieties of type shown in FIG. 7.

With reference again to FIG. 4 which depicts the second embodiment of the structure for attaining the actions described above, the printing pitch in the longitudinal direction of type drum 102 is the same as that of the drum of the first embodiment since the spirals are disposed in two tracks; hence, the pitch of drum 102 is twice that of drum 2. Accordingly, although the configuration of the cam faces 115*a*, 116*a* of cams 115, 116 in the type drum driving device are different from the cam face configurations of the first embodiment, the operation of the type drum driving device and hammer driving device, etc., is exactly the same as that of the first embodiment.

The hammer shift device which serves as printing column shift means is constructed and operates as follows. In the second embodiment, the number of hammers is half the total number of columns. Although hammers 103, 113 are rotatable about hammer shaft 117, they cannot move along the shaft in the axial direction. The hammer shaft itself is fixed to plungers 20*a*, 21*a* of two solenoids 20, 21. When hammers 103, 113 are to be moved in the direction of arrow B, an excitation current is supplied to solenoid 21 and cut off from solenoid 20, whereby plunger 21*a* is attracted in the direction of arrow B to shift the hammers in the same direction. When hammers 103, 113 are to be shifted in the direction of arrow A, an excitation current is supplied to solenoid 20 and cut off from solenoid 21, whereby plunger 20*a* is attracted in the direction of arrow A to shift the hammers in the same direction.

According to the second embodiment of the present invention as illustrated in FIGS. 4 are 5, the operation of selecting a variety of type faces proceeds as follows. If only alpha-numeric type is to be printed, type drum 102 travels axially in the direction of arrow A of FIG. 5, whereupon the alpha-numeric type passes the front faces of hammer heads 103'*a*, 113'*a* which have shifted to the even-numbered columns; when the drum travels axially in the direction of arrow B, the alpha-numeric type passes the front faces of hammer heads 103*a*, 113*a* which have shifted to the odd-numbered columns. If only kana type is to be printed, type drum 102 travels axially in the direction of arrow B, whereupon the kana type passes the front faces of hammer heads 103'*a*, 113'*a* which have shifted to the even-numbered columns; when the drum moves in the direction of arrow A, the kana type passes the front faces of hammer heads 103*a*, 113*a* which have shifted to odd-numbered columns. Thus, when it is desired to print only one variety of type, type drum 102 is reciprocated only once to print one line. When it is desired to mix and print both varieties of type, type drum 22 is reciprocated twice to print one line.

Although a hammer shifting method is adopted in the present embodiment as the printing column shift means, it is also possible to adopt systems which shift the recording paper, printing solenoids, etc. In other words, any system that prints columns by dividing printing into two operations may be employed.

A third embodiment of a line printer which employs the type drum of the present invention will now be described.

Figure 8:
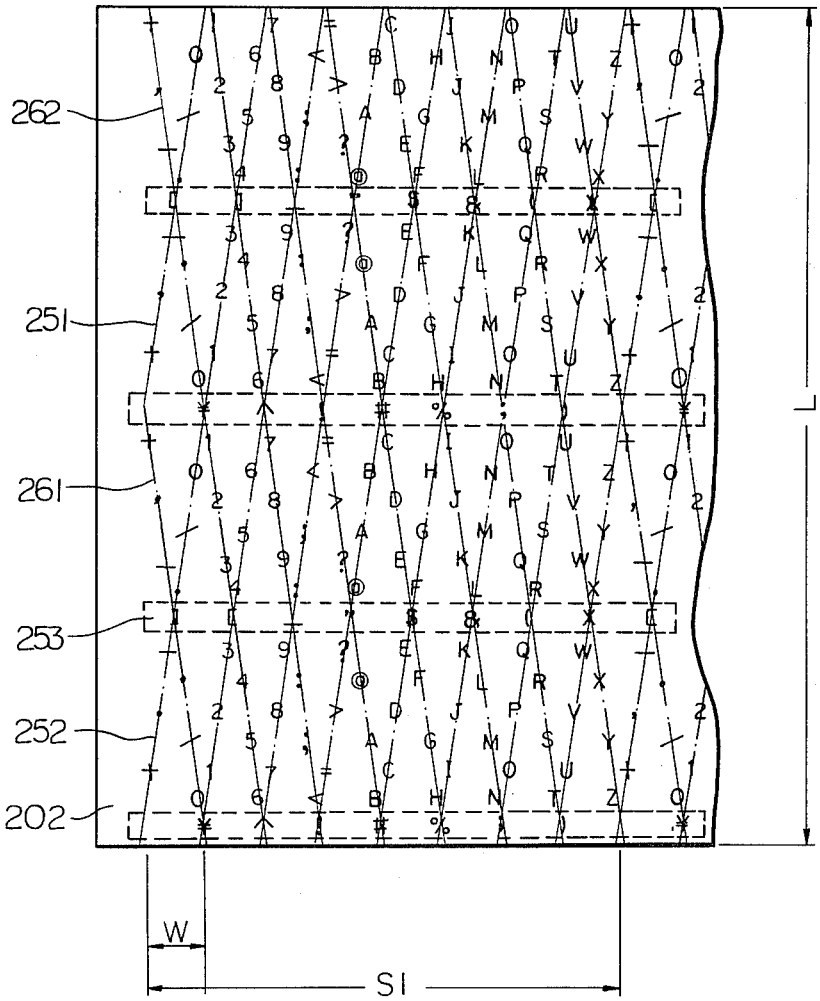
FIG. 8 is an expanded view of a third preferred embodiment of a type drum.

FIG. 8 is an expanded view of a portion of a type drum 202 having type faces disposed over its outer circumferential surface. The outer circumferential surface of the drum is provided with type sets 251, 252 each arrayed in a counter-clockwise spiral of double tracks, and with type sets 261, 262 each arrayed in a clockwise spiral of double tracks, each set having 64 varieties of type, namely numerals, English characters and alphanumeric symbols, there thus being 4 groups of the 64 varieties disposed in 4 turns of a spiral. Alphanumeric symbols with a low frequency of use that appear at the intersections of the sets 251, 252, 261, 262 are symbols for common use denoted by reference numeral 253. W designates the spacing between characters, S1 the amount of axial movement of the type drum (a distance equivalent to 8 columns of characters), and L denotes the total outer circumference of the drum. All 64 varieties of characters and symbols of a character set can be selectively printed in one line of print by rotating type drum 202 through four revolutions and simultaneously moving the drum to the left or right by the distance S1. Accordingly, two lines can be printed by reciprocating the drum once in the axial direction.

Figure 9:
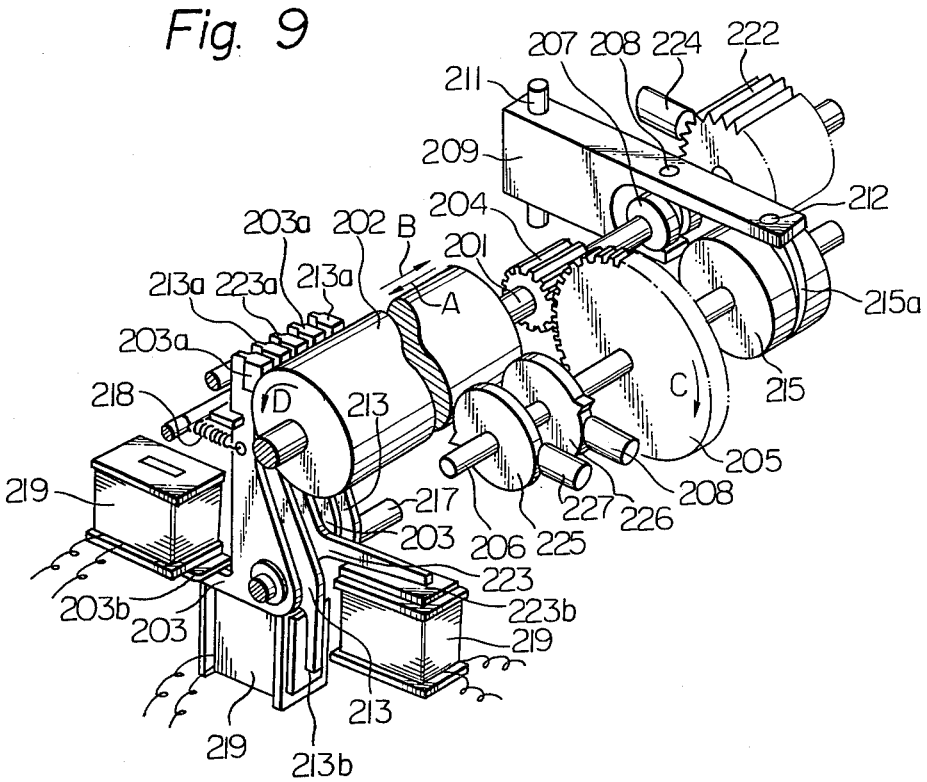
FIG. 9 is a perspective view of a line printer employing the type drum shown in FIG. 8.

FIG. 9 is a perspective view of the main structure of a printer for the third embodiment of the present invention, illustrating means for generating timing pulses which are also applicable to the other embodiments of the present invention, which is partially cut away. Type drum 202 (the overall axial length of which is partially shortened) is secured to drum shaft 201 and is provided over its outer circumferential surface with the type sets 251, 252 each arrayed in a counter-clockwise spiral of double tracks, and type sets 261, 262 each arrayed in a clockwise spiral of double tracks, each set having 64 varieties of type, and common use type faces 253 being provided at the intersections of each set, all as previously described with reference to FIG. 8. Drum shaft 201 is axially supported for both rotational motion and sliding motion in the axial direction. The type drum is rotated by means of a known transmission mechanism (not shown) that makes use of a motor to rotatingly drive drum shaft 201.

Means for reciprocatingly driving the type drum comprises a pinion 204 fixed to drum shaft 201, a rotatably journaled cam shaft 206, a gear 205 secured to cam shaft 206 and meshing with pinion 204 at a gear ratio of 1:9, a grooved cam 215 secured to cam shaft 206 and having a cam groove 215*a* adapted to control the axial movement of type drum 202 in synchronism with its rotation, a rocking lever 209 rockingly supported by a rocking lever shaft 211, a cam follower 212 fixed to the extremity of rocking lever 209 and adapted to engage with cam groove 215*a*, and a sleeve 207 having a circumferentially extending groove for engaging two upper and lower pins 208 secured to rocking lever 209.

Printing means comprise a plurality of hammers, three of which are designated as 203, 213 and 223, successively axially disposed for the required number of columns, each hammer being rockably supported by hammer shaft 217 and having a respective hammer head 203*a*, 213*a*, 223*a* for striking, through the intermediary of a recording paper and inked ribbon (neither of which are shown), the type faces of type sets 251, 252, 261, 262 arrayed in spiral form on the outer circumference of type drum 202. A plurality of springs 218 are adapted to bias hammers 203, 213, 223 such that the hammer heads 203*a*, 213*a*, 223*a* biased away from the circumference of the drum. A plurality of printing solenoids 219 are secured to a frame (not shown) so as to correspond with the armature portions 203*b*, 213*b*, 223*b*, of each hammer 203, 213, 223, each solenoid being adapted such that the passage of an excitation current therethrough causes the corresponding hammer head to strike the type drum against the biasing force of the spring. A type position detecting wheel 222 is fixed to cam shaft 210 and adapted to indicate the circumferential position of type faces from the type sets 251, 252, 261, 262, on the type drum. An electromagnetic detector 224 for type position detection is secured to a frame (not shown) in close correspondence with the type position detecting wheel 222 and adapted to detect the travel time of type faces from type sets 251, 252, 261, 262 on drum 202 as the type faces pass the hammer heads 203*a*, 213*a*, 223*a*. Type starting position detecting wheels 225, 226 for left and right traversals are secured to cam shaft 206 and adapted to indicate the type starting positions of type faces from sets 251, 252, 261, 262 on drum 202 when the drum is moved in the A and B directions in synchronism with its rotational movement. Electromagnetic detectors 227, 228 for detecting type starting positions, for left and right traversals, are secured to a frame (not shown) in close correspondence to respective type starting position detecting wheels 225, 226 and adapted to detect the respective type starting positions of type faces from type sets 251, 252, 261, 262 on drum 202 when the drum begins to move in the directions of arrows A or B. It should be noted that the number of columns has been abbreviated for the sake of clarity.

Figure 10:
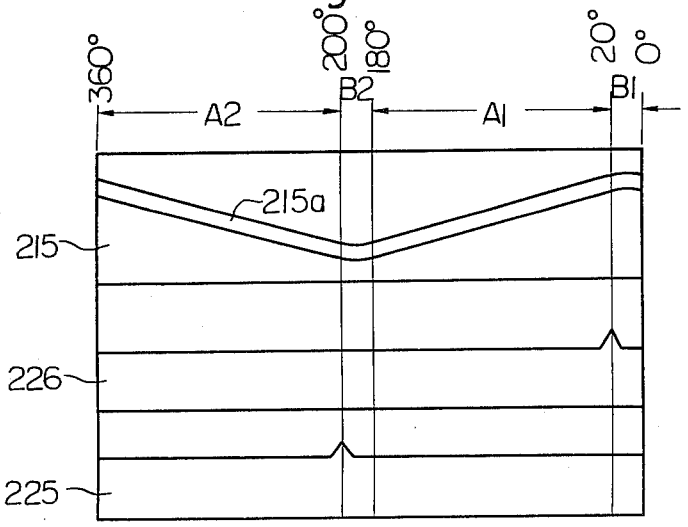
FIG. 10 is an expanded view useful for describing the positional relationship between a grooved cam and type starting position detecting wheels for traversals to the left and right in the third embodiment of the present invention.

FIG. 10 is a diagram useful for describing the positional relationship between grooved cam 215 and the type starting position detecting wheels 225, 226. The portions A1, A2 of grooved cam 215 impart to the type drum 202 axial movement synchronized with its rotational movement and proportional to a distance of 8 columns of characters over a period of four revolutions. The portions B1, B2 are adapted to change the reciprocating direction of drum 202 without subjecting the drum to violent changes in acceleration. FIG. 10 also shows the relationship between cam 215 and the positions of projections on type starting position detecting wheels 225, 226 as the projections pass the respective magnetic detectors 227, 228 for detecting type starting positions for left and right traversals.

FIG. 11A shows the relationship among type faces in each column for the counter-clockwise type sets 251, 252, these relationships being shown in correspondence with type position detection signals, type starting position signals for left traversals and type starting position signals for right traversals. An example will be described wherein type drum 202 moves in the direction of arrow B. P1 denotes type position detection pulses, P2 denotes type position pulses for traversals to the left, and P3 designates a type starting position pulse for traversals to the left. The array of type faces from the counter-clockwise type sets 251, 252 corresponding to the pulses P2 are designated by C1 through C8 which respectively denote the columns numbered 8n-7 (where n is a positive integer), 8n-6, 8n-5, 8n-4, 8n-3, 8n-2, 8n-1 and 8n. The pulses P1 are generated each time the projections on type position detecting wheel 222 pass the magnetic detector 224, as shown in FIG. 9, and the pulses therefore indicate the positions of type faces in type sets 251, 252, 261, 262 on type drum 202. The pulse P3 is generated when the projection on type starting position detecting wheel 225 passes magnetic detector 227 for detecting type starting positions for traversals to the left, and the pulse therefore indicates the starting position of a type array in the type sets 251, 252 at the change-over position from B2 to A2 of the cam 215 in FIG. 10 when the drum 202 begins to move in the direction of arrow B. The pulses P2 are readily synthesized by a known control circuit from the (2N−1)th pulse (where N is a positive integer) of the pulse train P1 indicative of the positions of type faces in type sets 251, 252, and the (7N−6)th pulse of pulse train P1 indicative of the positions of the common use type faces 253 at the intersections of the type sets 251, 252, 261, 262, these pulses being synthesized when pulse P3 is in synchronism with the pulses P1. A known control circuit can readily establish coincidence between the pulses P2 and the type information for a traversal to the left in correspondence with the type arrays C1, C2, C3, C4, C5, C6, C7, C8 of type sets 251, 252.

FIG. 11B shows the relationship among type position detection signals, type position signals for traversals to the right, and type starting position signals for traversals to the right. The type arrays of clockwise type sets 261, 262 corresponding to type position signals for traversals to the right shall be omitted. P4 denotes type position pulses for traversals to the right, and P5 a type starting position pulse for traversals to the right. In a manner similar to that above, the pulses P4 are readily synthesized by a known control circuit from the 2N−th pulse of the pulse train P1 indicative of the positions of type faces in type sets 261, 262, and the (7N−6)th pulse of pulse train P1 indicative of the positions of common use type faces 253 at the intersections, these pulses being synthesized when pulse P5 is in synchronism with pulses P1, this holding true also when type drum 202 moves in the direction of arrow A. Again, a known control circuit can readily establish coincidence between the pulses P4 and the type information for a traversal to the right in correspondence with the type arrays of type sets 261, 262.

In operation, drum shaft 201 is rotatingly driven in the direction of arrow P in FIG. 8 by a transmission mechanism which transmits the driving force of a motor which is not shown. Owing to this rotation, cam shaft 206 is rotatingly driven through pinion 204 and gear 205 in the direction of arrow C. This constitutes the rotating means for the type drum. Next, as reciprocating means, rocking lever 209 is caused to rock about rocking lever shaft 211 due to rotation of groove cam 215 and cam follower 212 which is engaged with the cam groove **215*a*. Owing to the rocking motion of rocking lever 209, axially directly sliding motion is transmitted to drum shaft 201 by means of the circumferentially extending groove in sleeve 207 that engages with the two pins 208 projecting inward from the top and bottom of the rocking lever. Type drum 202 is thus imparted with rotational and reciprocating motion so that the type sets 251, 252, 261, 262 pass the positions of hammer heads 203*a*, 213*a*, 223*a* of a plurality of groups of corresponding hammers 203, 213, 223. Owing to the rotation of drum shaft 201, type position detection pulses P1 indicative of type face positions in type sets 251, 252, 261, 262 are generated each time the projections on type position detection wheel 222 pass the position of magnetic detector 224 for detecting type positions. Further, owing to the rotation of cam shaft 206, the type starting position pulses P3, P5 for traversals to the left and right and indicative of the starting positions of type sets 251, 252, 261, 262 are generated at the change-over positions from B2 to A2 and from B1 to A1 of the cam 215 in FIG. 10 when the drum begins to move in the direction of arrow A and then in the direction of arrow B, these pulses occuring when the projections on type starting position detecting wheels 225, 226 for traversals to the left and right pass the positions of magnetic detectors 227, 228 for detecting the type starting positions for traversals to the left and right. Using a known control circuit, the type position pulses P2, P4 for traversals to the left and right indicative of type positions in the counter-clockwise type sets 251, 252 and clockwise type sets 261, 262 are readily synthesized by synchronizing the type position detection pulses P1 with the type starting position pulses P3, P5** for traversals to the left and right.

If printing information is applied as an input to the line printer, a known control circuit brings into coincidence the input printing information for each column with the type information symbols for left and right traversals that are collated with each column of type face arrays in the counter-clockwise type sets 251, 252 and clockwise type sets 261, 262 corresponding to the pulses P2, P4. At the time of coincidence, an excitation current is passed through respective printing solenoids 219 of the proper columns to attract the corresponding armature portions **203*b*, 213*b*, 223*b* against the biasing force of springs 218 in order to actuate each respective hammer 203, 213, 223. As desired characters for each column are being selected from type sets 251, 252, 261, 262 on the outer circumferential surface of moving type drum 202, each hammer head 203*a*, 213*a*, 223*a*** is caused to strike a recording paper through the intermediary of an inked ribbon (neither the ribbon nor recording paper being shown), whereby the input printing information is recorded on the recording paper.

Other means which can be used to reciprocate the type drum of the invention are such devices as a plate cam or linear motor, etc. As recording means it is possible to utilize a snatch roll to apply the required typing force to the hammers.

FIG. 12 illustrates a fourth embodiment of the present invention. Since the drive mechanism and driving method are identical with those of the third embodiment, they need not be described again here. The description will be limited to the array of type faces on the type drum. The outer circumferential surface of the drum 302 is provided with type sets 351, 352 each arrayed in a counter-clockwise spiral of double tracks, and with type sets 361, 362 each arrayed in a clockwise spiral of double tracks, each set having 126 varieties of type, namely numerals, English characters, alphanumeric symbols, kana characters and kana symbols, there thus being two groups of the 126 varieties disposed in 4.5 turns of a spiral. Numerals, alpha-numeric symbols and the English character E that have a high frequency of use are provided at the intersections of the type sets 351, 352, 361, 362 has an example of common use type faces 353. W designates the spacing between characters, S2 the amount of axial movement of the type drum (a distance equivalent to 9 columns of characters), and L denotes the total outer circumference of the drum. All characters and symbols can be selectively printed by rotating type drum 302 through 10 revolutions (of which one revolution is the change-over portion of the reciprocating motion of the drum corresponding to B1 and B2 in FIG. 10) and simultaneously reciprocating the drum once. In a case where only the common use type faces 353 are to be printed, type drum 302 is rotated through five revolutions (of which one-half revolution is the change-over portion of the reciprocating motion of the drum) and simultaneously moved to the left or right by the distance S2. This makes it possible to selectively print all of the common use type faces 353 at a printing speed which is twice that needed to selectively print all the characters and symbols.

A fifth embodiment of the present invention will now be described while referring at the same time to an example of the prior art for the purpose of facilitating the description.

FIG. 13 is an expanded view of an array of type faces on a conventional type drum, wherein a denotes type pitch in the axial direction, and b denotes type pitch in the circumferential direction. FIG. 14, on the other hand, is an expanded view of a fifth embodiment of an array of type faces on a type drum according to the present invention, wherein c denotes type pitch in the axial direction, d denotes type pitch in the circumferential direction, and e denotes the amount of circumferential stagger of type faces in the clockwise and counter-clockwise type sets 450, 460. As can be seen in FIG. 14, the array of type faces on the drum of the present embodiment comprises a clockwise type set 460 each type face of which has a circumferential pitch d that is twice the circumferential pitch b of the prior art, the type faces being located on a clockwise spiral of a single track having an axial pitch c which is also twice the longitudinal or axial pitch a of the prior art, whereby three full turns of the spiral accommodates all the varieties of type, and a counter-clockwise type set 450 each type face of which has the same circumferential pitch d as that of the clockwise type set 460, the type faces being located on a counter-clockwise spiral of a single track having the same axial pitch c as that of the clockwise spiral of a single track, whereby three full turns of the spiral accommodates all the varieties of type. Each of the type faces in both sets 450, 460 are circumferentially staggered with respect to each other by an amount e which is one-half of the circumferential pitch d (the amount e being equal to the circumferential pitch b of the prior art). The clockwise type set 460 is intended for printing even-numbered columns, and the counter-clockwise set 450 for printing odd-numbered columns.

Owing to the arrangement of type faces as described above, each type face has a corresponding neighboring portion in the printing direction, that is, in the direction of axial travel, that does not possesses a type face. A concrete example of the varieties of type positioned on the type drum of the present embodiment is shown in FIG. 15. The first turn of the clockwise type set 460 has an array of 22 varieties of type from the symbol ! to the numeral 6, the second turn an array of 22 varieties of type from the numeral 7 to the English character L, and the third turn an array of 22 varieties of type from the English numeral M to the erasure symbol ⊠; thus, three full turns of the clockwise spiral of type set 460 accommodates 66 varieties of type. Similarly, the first turn of the counter-clockwise type set 450 has an array of 22 varieties of type from the symbol "," to English character A, the second turn an array of 22 varieties of type from the English character B to the English character W, and the third turn an array of 22 varieties of type from the English character X to the symbol +; thus, three full turns of the counter-clockwise spiral of type set 450 accommodates 66 varieties of type.

It is obvious from FIG. 15 that, according to the type drum of the present embodiment, 22 type faces are accommodated in one turn of the spiral of clockwise type set 460, and 22 type faces in one turn of the spiral of counter-clockwise type set 450, for a total of 44 type faces. Thus, 66 varieties of type are accommodated by disposing the type faces in a spiral of three turns. According to the prior art type drum, on the other hand, 66 type faces must be disposed in the circumferential direction of the type drum in order to accommodate the same number of type varieties as the present embodiment. Accordingly, the diameter of the type drum of the present embodiment need be only two-thirds that of the prior art type drum, thereby allowing a smaller type drum to be obtained. The structure and operation of the type drum drive means and hammer means in the present embodiment are exactly the same as that of the first embodiment so that a detailed description of these aspects has been omitted.

The type drum of the present invention will now be applied to a line printer for printing on thin paper having little rigidity, such as paper of 45 or 55 kg weight. This embodiment will be described while making comparisons to the fifth embodiment which was described above. Since all other structural elements are identical, they need not be described here.

Referring now to FIG. 16 for a description of the printing hammer means in a line printer for printing on thin paper, printing hammers 503 which are half the number of printing columns are rotatably supported by a hammer shaft 517. Each hammer 503 has a hammer head 503*a* formed to have a width i for spanning two printing columns, each hammer head being disposed confronting the outer circumferential surface of type drum 502 in close proximity thereto. Each hammer 503 is normally biased away from type drum 502 by springs 518, and is provided with a corresponding printing solenoid 519 which, when supplied with an excitation current, attracts its corresponding hammer 503 so that the type head 503*a* strikes the type drum against the biasing force of the spring to performing a printing operation.

FIGS. 17 and 18 clarify the difference between the hammers of the fifth and sixth embodiments. In FIG. 17 which shows the hammers of the fifth embodiment, two hammers 403 having a hammer width e are disposed in an interval corresponding to a longitudinal pitch c which spans two printing columns, each hammer facing drum 402 thereby comprising a so-called single-column hammer. On the other hand, one hammer having a hammer width i is disposed in an interval corresponding to a longitudinal pitch c which also spans two printing columns, each hammer facing drum 502 thereby comprising a so-called two-column hammer which spans two printing columns. The hammers 503 are thus adapted to print two columns each.

As can readily be understood from each of the foregoing embodiments, disposing a plurality of type faces in the form of a spiral on the outer circumferential surface of a type drum allows a desired variety of type to be advantageously printed by 3 or 4 revolutions of the drum. As a result, the diameter of the type drum can be made shorter than that of the prior art to thereby reduce the size of the drum and hence the overall size of the line printer. The size reduction of the type drum also facilitates manufacture and lowers cost. Reciprocating the drum in synchronism with its rotational motion permits printing without axially directed shifting, so that noise due to violent shifting operations can be prevented. As the drum is not subjected to axially directed impact which generally accompanies shifting, and by virtue of the fact that the smaller drum size reduces its moment of inertia, there is no need for peripheral drum components such as stoppers and shafts, and an improvement is attained in the durability and reliability of the type drum drive means. If a type drum having the same diameter as the drum of the present invention is utilized in a printer that requires a shift operation, it is necessary to consider the time needed for shifting. In accordance with the present invention, however, drum traversal eliminates losses due to shift time so that an improvement in printing speed is obtained.

It is obvious from the description of the second embodiment of the present invention that the effects derived from the first embodiment, namely effects attributable to the reduction of drum diameter and the reciprocating traversal of the drum, are also obtained in the second embodiment, as well as the ability to selectively print 64 varieties of alpha-numeric type and 64 varieties of kana type from a total of 128 kinds of type. It is also possible to perform printing at a proximately twice the speed when mixing and printing the 128 kinds of type. While, in the second preferred embodiment, the present invention has been described with reference to a total of 128 kinds of type, it should be born in mind that, in general, the present invention makes it possible to selectively print N varieties of type from a total of 2N kinds of type and the printing can be performed at a proximately twice the speed when mixing and printing the 2N kinds of type.

In accordance with the third and fourth embodiments of the present invention, a line printer can be provided wherein the density of type faces on the type drum can be increased and the selection of type faces rapidly performed without increasing the peripheral speed of the drum by employing as common use type faces a plurality of type faces each of which is located at the intersections of type sets comprising clockwise and counter-clockwise spirals of a plurality of tracks of type faces. Moreover, the printing speed can be doubled if only the common use type faces are printed.

The effects of the fifth and sixth embodiments of the present invention are as follows. In general, the propelling force of a printing hammer acts, through the intermediary of the recording paper, not only on the desired type face but also on the neighboring type face. The side printing phenomenon arises if the force acting on the neighboring type face is large. However, the longer the distance between the desired type face and the neighboring type face, or the lower the rigidity of the recording paper, the weaker the force acting upon the neighboring type face. Since the type drum used in a line printer of the type described above is cylindrical, the force exerted through the recording paper and acting upon a circumferentially neighboring type face is small even if a highly rigid recording paper is used. In the fifth and sixth embodiments of the present invention, a single type face on the type drum has a corresponding neighboring portion in the direction of longitudinal travel that does not possess a type face; hence, in a line printer that employs a highly rigid recording paper, the side printing phenomenon can be prevented by providing a hammer for each printing column, as in the fifth embodiment. On the other hand, in a line printer that employs a recording paper having a low rigidity, hammers are provided that span two printing columns, as in the sixth embodiment. This reduces the number of hammers and printing solenoids by one-half, thereby making it possible to enhance the reliability of the line printer while lowering its price and reducing its size. Line printers suited for various kinds of recording paper quality can thus be obtained.

What is claimed is:

1. A line printer for impact printing upon a recording medium, comprising:

a type drum having at least a first and a second set of type faces formed on an outer cylindrical surface thereof, comprising a first and a second group of characters respectively, said first set of type faces being arranged in a helical path with a clockwise orientation relative to the axis of said type drum and said second set of type faces being arranged in a helical path with a counter-clockwise orientation relative to the drum axis, said helical paths of the first and second sets of type faces being of identical pitch and lead angle;

means for continuously rotating said type drum about its axis while alternately and repetitively traversing the drum in opposite directions along the drum axis;

a plurality of hammers arranged adjacent to said type drum, in a line which is parallel to said drum axis, with a fixed offset being provided between said hammers, the ratio of said offset between the hammers to said pitch of said helical paths of the type faces being an integer, said hammers being restrained against movement in a direction parallel to the type drum axis during each traverse of said type drum and arranged such that at least a part of said first set of type faces become successively aligned opposite each of said hammers as said type drum rotates during a traverse of said type drum in a first axial direction and at least a part of said second set of type faces become successively aligned opposite each of said hammers during a traverse of said type drum in a second axial direction opposite to said first axial direction; and hammer actuating means operated in cooperation with said type drum rotating and traversing means for actuating selected ones of said hammers to impact selected ones of said first set of type faces through the intermediary of said recording medium during a traverse of said type drum in said first axial direction and for actuating selected ones of said hammers to impact selected ones of said second set of type faces during a traverse of said type drum in said second axial direction at appropriate timings for printing a plurality of characters of a print line during each traverse of said type drum.

2. A line printer according to claim 1, in which all of the characters to be printed in a first print line are printed from said first group of characters of said first type face set during a first traverse of said type drum in said first axial direction, and in which all of the characters to be printed in a second print line which immediately succeeds said first print line on the recording medium are printed from said second group of characters of said second type face set during a second traverse of said type drum in said second axial direction immediately succeeding said first traverse.

3. A line printer according to claim 1, in which a part of the characters to be printed in a first print line are printed from said first group of characters of said first type face set during a first traverse of said type drum in said first axial direction, and in which another part of the characters to be printed in said first print line are printed from said second group of characters of said second type face set during a second traverse of said type drum in said second axial direction immediately succeeding said first traverse.

4. A line printer according to claim 1, in which said first group of characters of said first type face set and said second group of characters of said second type face set are identical to one another.

5. A line printer according to claim 1, in which said first group of characters of said first type face set and said second group of characters of said second type face set are different from one another.

6. A line printer according to claim 5, in which said first group of characters of said first type face set includes English alphabetic characters and in which said second group of characters of said second type face set includes Japanese Kana characters.

7. A line printer according to claim 1, in which said first set of type faces and said second set of type faces each comprises a plurality of character sets, with the character sets within one set of type faces being identical to one another and repeated cyclically along the helical path of said one set of type faces.

8. A line printer according to claim 7, in which each of the character sets in a set of type faces occupies an integral number of helix pitches of the helical path of said set of type faces, and in which all of the characters of a character set pass successively before each of said hammers during a number of rotations of said type drum equal to said integral number of helix pitches.

9. A line printer according to claim 1, in which said means for rotating and traversing said type drum comprise:

a rotatably mounted drum shaft for receiving said type drum to be fixedly mounted axially thereon;
a pinion mounted on said drum shaft;
a sleeve fixedly mounted axially on said drum shaft;
a rotatably mounted cam shaft;
a gear fixedly mounted on said cam shaft and meshing with said pinion;
cam means fixedly mounted on said cam shaft;
drive means for rotating said drum shaft, thereby rotating said cam shaft; and
a rocking lever shaft mounted with the axis thereof at right angles to the axis of said drum shaft, and a rocking lever mounted on said rocking lever shaft to be rotatably movable about the axis of said rocking lever shaft, said rocking lever engaging slidably with said cam means and said sleeve for repetitively and alternately traversing said type drum opposite directions along said drum shaft axis in accordance with the motion of said cam means.

10. A line printer according to claim 9, in which said cam means is formed such that the rate of movement of said type drum with respect to said drum shaft axis during said traverses is essentially constant.

11. A line printer according to claim 9, and further comprising timing signal generating means for generating timing signals to be applied to said hammer actuating means, for thereby actuating said hammers at appropriate timings with respect to the instantaneous positions of said type faces.

12. A line printer according to claim 11, in which said timing signal generating means comprise:

a type position detection wheel fixedly mounted axially on said drum shaft and having a plurality of protrusions on a periphery thereof, with the circumferential position of each of said protrusions corresponding to the circumferential position of a plurality of said type faces on said type drum;
a type position detection transducer fixed adjacent to said type position detection wheel for generating an electrical signal constituting a type position detection pulse each time one of said protrusions on said type position detection wheel becomes aligned opposite said type position detection transducer as said type position detection wheel rotates;
first and second type starting position detection wheels fixedly mounted axially on said cam shaft, with a protrusion being provided on the circumference of each of said first and second starting position detection wheels; and
first and second type starting position detection transducers mounted fixedly adjacent to said first and second type starting position detection wheels respectively, with the relative positions between said position detection transducers, type starting position detection wheels and said cam means being such that an electrical signal constituting a first type starting position detection pulse is generated by said first type starting position detection transducer when said type drum completes a traverse in a first axial direction and a second starting position detection pulse is generated by said second type starting position detection transducer when said type drum completes a traverse in a second axial direction opposite to said first axial direction.

13. A line printer according to claim 12, in which said first and second type starting position detection transducers and said type position detection transducer are electromagnetic transducers.

14. A line printer according to claim 1, in which said recording medium has even-numbered columns of print and odd-numbered columns of print, in which each type face of said first set of type faces has a fixed circumferential displacement with respect to the adjacent type faces of said second set of type faces, and in which each of said hammers spans a distance in the direction of said type drum axis which is greater than one half of the pitch of said helical paths of the first and second sets of type faces, with each of said first set of type faces being thereby successively aligned in relation to said hammers in positions corresponding to the even-numbered columns of print on said recording medium during a traverse of the type drum in said first axial direction and each of said second set of type faces being successively aligned in positions corresponding to the odd-numbered columns during a traverse of the type drum in said second axial direction.

15. A line printer for impact printing upon a recording medium, comprising:

a type drum having a first set of type faces formed on an outer cylindrical surface thereof comprising a first group of characters, said first set of type faces being arranged in a clockwise helical path with respect to the axis of said type drum, with the pitch of said helical path of the first set of type faces being equal to twice the lateral offset between adjacent columns to be printed on said recording medium, a second set of type faces formed on said cylindrical surface of the type drum comprising a second group of characters, said second set of type faces being arranged in a clockwise helical path with respect to said drum axis, the pitch of said helical path of the second set of type faces being equal to the pitch of said helical path of the first set of type faces, and said helical path of the second set of type faces being displaced along the drum axis relative to said helical path of the first set of type faces by an amount which is equal to said lateral offset between said adjacent printed columns, a third set of type faces formed on said cylindrical surface of the type drum comprising a third group of characters, said third set of type faces being arranged in a counter-clockwise helical path with respect to the drum axis, with the pitch of said helical path of the third set of type faces being equal to the pitch of said helical paths of the first and second sets of type faces, a fourth set of type faces formed on said cylindrical surface of the type drum comprising a fourth group of characters, said fourth set of type faces being arranged in a counter-clockwise helical path with respect to the drum axis, with the pitch of said helical path of the fourth set of type faces being equal to the pitch of said helical path of the third set of type faces, and said helical path of the fourth set of type faces being displaced along the type drum axis by an amount which is equal to said lateral offset between printed columns;

means for continuously rotating said type drum about its axis while alternately and repetitively traversing the type drum in opposite directions along the drum axis;

a plurality of hammers arranged adjacent to said type drum, in a line parallel to said type drum axis with a fixed offset provided between said hammers, said fixed offset being equal to said pitch of the helical paths of the first, second, third and fourth sets of type faces;

hammer shift means for selectively shifting said plurality of hammers collectively to a first shift position and a second shift position, said shifting being performed in a direction parallel to the type drum axis upon completion of a first traverse of said type drum in a first axial direction and before initiation of a second traverse of said type drum in a second axial direction opposite said first axial direction, said hammer shifting means holding said plurality of hammers stationary in said first and second shift positions with respect to movement parallel to the type drum axis during each traverse of the type drum in said first and second axial directions, said first and second shift positions being arranged such that each of the type faces of said first type face set becomes successively aligned opposite each of said hammers during a traverse of said type drum in said first axial direction while said plurality of hammers are in said first shift position, each of said type faces of said second set of type faces becomes successively aligned opposite each of said hammers during a traverse of said type drum in said first axial direction while said plurality of hammers are in said second shift position, each of said type faces of said third set of type faces becomes successively aligned opposite each of said hammers during a traverse of said type drum in said second axial direction while said plurality of hammers are in said first shift position, and each of said type faces of said fourth set of type faces becomes successively aligned opposite each of said hammers during a traverse of said type drum in said second axial direction while said plurality of hammers are in said second shift position; and hammer actuating means operated in cooperation with said type drum rotation and traversing means for actuating selected ones of said hammers to impact selected ones of said first set of type faces through the intermediary of said recording medium during a traverse of said type drum in said first axial direction while said plurality of hammers are in said first shift position, to impact selected ones of said second set of type faces during a traverse of said type drum in said first axial direction while said plurality of hammers are in said second shift position, to impact selected ones of said third set of type faces during a traverse of said type drum in said second axial direction while said plurality of hammers are in said first shift position, and to impact selected ones of said fourth set of type faces during a traverse of said type drum in said second axial direction while said plurality of hammers are in said second shift position.

16. A line printer according to claim 15, in which said first group of characters and said fourth group of characters are identical to each other and in which said second group of characters and said third group of characters are identical to each other and include characters not included in said first and fourth groups of characters.

17. A line printer according to claim 16, in which said hammer actuating means actuates selected ones of said hammers to print a part of the characters of a print line from said first group of characters during a first traverse of said type drum in said first axial direction while said plurality of hammers are in said first shift position and to print a remainder of the characters of said print line from said fourth group of characters during a second traverse of said type drum in said second axial direction while said plurality of hammers is in said second shift position, to thereby print a line containing only characters included in said first and fourth groups of characters.

18. A line printer according to claim 16, in which said hammer actuating means actuates selected ones of said hammers to print a part of the characters of a print line from said first group of characters during a first traverse of said type drum in said first axial direction while said plurality of hammers are in said first shift position and to print another part of the characters of said print line from said fourth group of characters during a second traverse of said type drum in said second axial direction immediately subsequent to said first traverse, while said plurality of hammers are in said second shift position, and further actuates selected ones of said hammers to print yet another part of the characters of said print line from said second group of characters during a third traverse of said type drum in said first axial direction while said plurality of hammers are in said first shift position, said third traverse being immediately subsequent to said second traverse, and also actuates selected ones of said hammers to print the remainder of the characters of said print line during a fourth traverse of said type drum, in said second axial direction, while said plurality of hammers is in said second shift position, said fourth traverse being immediately subsequent to said third traverse, whereby said print line contains characters included in said first and second groups of characters and in said third and fourth groups of characters upon completion of said fourth traverse of the type drum.

19. A line printer according to claim 16, in which said first group of characters and said fourth group of characters include English alphabetic characters, and in which said second group of characters and said third group of characters include characters of an alphabet other than the English alphabet.

20. A line printer according to claim 19, in which said second group of characters and said third group of characters include Japanese Kana characters.

21. A line printer according to claim 19, in which said second group of characters and said third group of characters further include numeric symbols.

22. A line printer for impact printing upon a recording medium, comprising:

a type drum having a first plurality of sets of type faces formed on an outer cylindrical surface thereof, each of said first plurality of type face sets comprising a group of characters common to each of said type face sets and being arranged on said cylindrical surface in a clockwise helical path with respect to the axis of said type drum, with a fixed offset in a direction along the type drum axis being provided between each of the helical paths of said first plurality of type sets, said fixed offset being equal to the lateral offset between adjacent columns of a print line to be printed on said recording medium, said type drum further having a second plurality of sets of type faces formed on said cylindrical surface, each of said second plurality of type face sets comprising said group of characters common to each of said second plurality of type face sets and identical to said group of characters of said first plurality of type face sets, each of said second plurality of type face sets being arranged on said cylindrical surface in a counter-clockwise helical path, with a fixed offset in the axial direction being provided between each of said helical paths of the second plurality of type face sets that is equal to said fixed offset provided between each of said first plurality of type face sets;

means for rotating said type drum about its axis while alternately and repetitively traversing the type drum in opposite direction along the type drum axis;

a plurality of hammers arranged in a line parallel to said type drum axis adjacent to said type drum, with a fixed offset in the direction of said type drum axis being provided between said hammers, said fixed offset of said hammers being equal to said fixed offset provided between the helical paths of said first plurality of type face sets, each of said hammers being positioned with respect to the axis and circumference of said type drum such that type faces of a corresponding one of said first plurality of type face sets successively become aligned opposite thereto during a traverse of said type drum in a first axial direction and type faces of a corresponding one of said second plurality of type face sets become successively aligned opposite thereto during a traverse of said type drum in a second axial direction opposite to said first axial direction; and hammer actuating means for actuating selected ones of said hammers to impact selected type faces of said first plurality sets of type faces through the intermediary of said recording medium during a first traverse of said type drum in said first axial direction, to thereby perform printing of a first line of print, and for actuating selected ones of said hammers to impact selected type faces of said second plurality of set of type faces during a second traverse of said type drum in said second axial direction immediately subsequent to said first traverse, to thereby perform printing of a second line of print, said hammer actuating means being operated in cooperation with said means for rotating and traversing the type drum.

23. A line printer according to claim 22, in which said first plurality of sets of type faces comprises a first and a second set of type faces and in which said second plurality of sets of type faces comprises a third and a fourth set of type faces, whereby a first line of print is printed on said recording medium by said hammers impacting on selected type faces of said first and second sets of type faces through the intermediary of said recording medium during a first traverse of said type drum in said first axial direction in which said type drum is rotated through four revolutions about its axis, and whereby a second line of print is printed on said recording medium by said hammers impacting on selected type faces of said third and fourth sets of type faces during a second traverse of said type drum in said second axial direction immediately subsequent to said first traverse, in which said type drum is rotated through four revolutions about its axis.

24. A line printer according to claim 22, in which said first plurality of type face sets comprises a first and a second type face set, and said second plurality of type face sets comprises a third and a fourth type face set, each of said first, second, third and fourth type face sets consisting of a character set which is common to each of said type face sets, said character set being repeated cyclically along the helical path of each of said type face sets.

25. A line printer according to claim 24, in which said character set includes numerals and English alphabetic characters.

26. A line printer according to claim 24, in which said character set includes numerals, English alphabetic characters and characters of an alphabet other than English.

27. A line printer according to claim 24, in which a plurality of type faces are arranged on said type drum surface at positions corresponding to intersections between the helical paths of said first and third type face sets and said second and fourth type face sets.

28. A type drum for a line printer characterized by at least a first and a second set of type faces each comprising a character set and formed on an outer cylindrical surface of said type drum, said first set of type faces being arranged in a helical path with a clockwise orientation relative to the axis of said type drum and said second set of type faces being arranged in a helical path of counter-clockwise orientation, said character sets being repeated a plurality of times along the helical paths of said first and second sets of type faces, respectively, said helical paths of the first and second sets of type faces being of identical pitch and lead angle to one another, the number of turns of the helical path of said first set of type faces and of the helical path of said second set of type faces respectively being equal to the number of columns to be printed in a line of print by said line printer.

29. A type drum for a line printer according to claim 28, in which an identical character set is common to said first and second sets of type faces.

30. A type drum for a line printer according to claim 28, in which the character set of said first set of type faces and the character set of said second set of type faces are different from one another.

31. A type drum for a line printer according to claim 28, in which said character set occupies a distance corresponding to an integral number of pitches of the helical path of each set of type faces.

32. A type drum for a line printer characterized by a first and a second plurality of sets of type faces formed on an outer cylindrical surface of said type drum, with each of said first plurality of sets of type faces comprising a plurality of type faces arrayed along a helical path having a clockwise orientation relative to the axis of said type drum and each of said second plurality of sets of type faces comprising a plurality of type faces arrayed along a helical path having a counter-clockwise orientation, with each of said helical paths being of identical pitch and lead angle, each of said first plurality of sets of type faces being spaced apart along the axial direction of the type drum by a distance equal to one half of the pitch of said helical path.

* * * * *

UNITED STATES PATENT AND TRADEMARK OFFICE

CERTIFICATE OF CORRECTION

PATENT NO. : 4,230,039

DATED : October 28, 1980

INVENTOR(S) : Nagao MIZUTANI et al.

It is certified that error appears in the above-identified patent and that said Letters Patent are hereby corrected as shown below:

On the first page of the patent, under the heading "Foreign Application Priority Date", change the serial number of the last listed Japanese patent application from "52-50206" to -- 52-60206 --.

Signed and Sealed this

*Second* Day of *June 1981*

[SEAL]

*Attest:*

RENE D. TEGTMEYER

*Attesting Officer*

*Acting Commissioner of Patents and Trademarks*